US011193339B2

(12) United States Patent
El Mallawany

(10) Patent No.: US 11,193,339 B2
(45) Date of Patent: Dec. 7, 2021

(54) CONCENTRIC DISCONNECT TOOL WITH MULTIPLE ELECTRICAL CONDUCTORS

(71) Applicant: Halliburton Energy Services, Inc., Houston, TX (US)

(72) Inventor: Ibrahim El Mallawany, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 47 days.

(21) Appl. No.: 16/632,004

(22) PCT Filed: Jun. 28, 2019

(86) PCT No.: PCT/US2019/039824
§ 371 (c)(1),
(2) Date: Jan. 17, 2020

(87) PCT Pub. No.: WO2020/263272
PCT Pub. Date: Dec. 30, 2020

(65) Prior Publication Data

US 2021/0010333 A1 Jan. 14, 2021

(51) Int. Cl.
*E21B 17/02* (2006.01)
*E21B 17/06* (2006.01)

(52) U.S. Cl.
CPC ..... *E21B 17/06* (2013.01); *E21B 17/023* (2013.01); *E21B 17/028* (2013.01)

(58) Field of Classification Search
CPC ..... E21B 17/023; E21B 17/028; E21B 17/06
See application file for complete search history.

(56) References Cited

U.S. PATENT DOCUMENTS 2,178,931 A * 11/1939 Crites ..... H01B 7/0072 439/191
3,879,097 A 4/1975 Oertle
(Continued)

FOREIGN PATENT DOCUMENTS

GB 2263203 A 7/1993

OTHER PUBLICATIONS

"Disconnect Tools Ease Removal of Upper Completion", Young Technology Showcase, JPT, Aug. 2013, pp. 36-37.
(Continued)

*Primary Examiner* — Matthew R Buck
(74) *Attorney, Agent, or Firm* — Gilliam IP PLLC

(57) ABSTRACT

A disconnect tool can be part of a production string in a wellbore. The disconnect tool can include a disconnect sub and a disconnect receptacle. The disconnect sub can be inserted into the disconnect receptacle such that the disconnect sub is concentric with the disconnect receptacle. The disconnect sub and the disconnect receptacle can include bands having multiple electrically conductive sections separated by an electrically insulating material. Insertion of the disconnect sub into the disconnect receptacle cause the electrically conductive sections of the disconnect sub to contact the electrically conductive sections of the disconnect receptacle, thereby completing multiple electrical connections between a control system uphole of the disconnect tool and one or more devices downhole from the disconnect tool along the lower portion of the production string. The disconnect tool allows the upper portion of the production string to be removed leaving devices in the lower production string undisturbed.

20 Claims, 8 Drawing Sheets

(56) References Cited

U.S. PATENT DOCUMENTS

| | | | | |
|---|---|---|---|---|
| 4,690,212 | A | 9/1987 | Termohlen | |
| 5,577,925 | A | 11/1996 | Schnatzmeyer et al. | |
| 5,967,816 | A | 10/1999 | Sampa et al. | |
| 6,012,518 | A | 1/2000 | Pringle et al. | |
| 6,123,561 | A * | 9/2000 | Turner | E21B 17/028 439/194 |
| 6,655,464 | B2 * | 12/2003 | Chau | E21B 47/0232 166/380 |
| 7,219,740 | B2 | 5/2007 | Saucier | |
| 7,644,755 | B2 * | 1/2010 | Stoesz | E21B 17/028 166/65.1 |
| 7,819,666 | B2 | 10/2010 | Sihler et al. | |
| 8,192,213 | B2 | 6/2012 | Braden et al. | |
| 10,060,196 | B2 * | 8/2018 | Richards | E21B 17/003 |
| 2003/0211768 | A1 * | 11/2003 | Cameron | H01R 13/523 439/191 |
| 2004/0242044 | A1 * | 12/2004 | Head | E21B 17/028 439/190 |
| 2009/0166087 | A1 * | 7/2009 | Braden | H01R 13/533 175/40 |
| 2009/0322553 | A1 * | 12/2009 | Clark | E21B 17/003 340/854.6 |

OTHER PUBLICATIONS

PCT Application Serial No. PCT/US2019/039824, International Search Report, dated Mar. 26, 2020, 3 pages.
PCT Application Serial No. PCT/US2019/039824, International Written Opinion, dated Mar. 26, 2020, 6 pages.

* cited by examiner

CONCENTRIC DISCONNECT TOOL WITH MULTIPLE ELECTRICAL CONDUCTORS

TECHNICAL FIELD

The disclosure generally relates to the field of wellbore strings, and more particularly to a disconnect tool with multiple electrical conductors for use in a wellbore string.

BACKGROUND

A production string typically comprises tubing that is run into the casing of an oil and gas well and is used to transfer wellbore fluids to and from the surface. Additionally, the production string may have conduits for supplying control fluids to downhole tools, for delivering injection fluids to downhole formations or for providing hydraulic power for actuation of downhole tools. Further, the production string may have conduits for containing conductors (e.g., wires) that communicate electrical signals to and from downhole instrumentation and devices. At some points in the production string, the conduits can be external to the production string tubing or well tools. At other points, the conduits may pass downward through the tools or be connected by fittings to ports, channels or small diameter bores within the well tubulars or tools.

It can be desirable or necessary to break a connection in a production string in order to permit a portion of the string to be withdrawn from the well bore while another portion of the string remains installed below the surface. For example, it may be necessary to break a connection in a production string during a workover operation. Following the workover operation, the portion of the string that was withdrawn can be replaced.

BRIEF DESCRIPTION OF THE DRAWINGS

Embodiments of the disclosure may be better understood by referencing the accompanying drawings.

DESCRIPTION OF EMBODIMENTS

Figure 1:
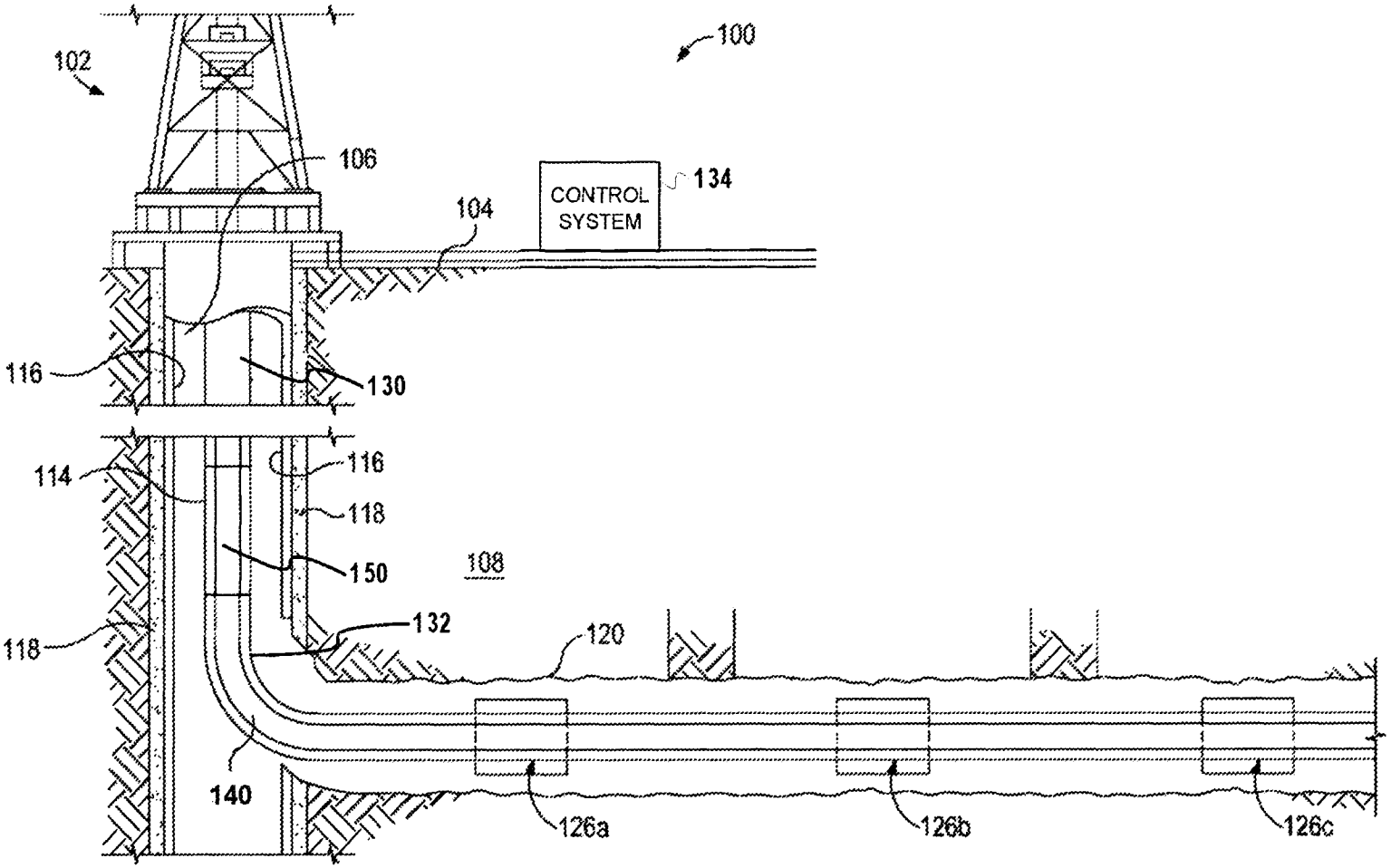
FIG. 1 illustrates an example well system that may employ one or more embodiments of the fluid density measurement tool described herein.

The description that follows includes example systems, methods, techniques, and program flows that embody aspects of the disclosure. However, it is understood that this disclosure may be practiced without these specific details. For instance, this disclosure refers to a disconnect tool that is generally annular in illustrative examples. Embodiments of this disclosure can be used any other type of disconnect tool having a shape that is not annular. In other instances, well-known structures and techniques have not been shown in detail in order not to obfuscate the description.

In the discussion that follows, the use of directional terms, such as above, below, upper, lower, upward, downward, uphole, downhole, and the like, are used in relation to the illustrative embodiments as they are depicted in the figures herein, the upward direction being toward the top of the corresponding figure and the downward direction being toward the bottom of the corresponding figure, the uphole direction being toward the surface of the well and the downhole direction being toward the top or bottom of the well. The use of a directional term with respect to the figures does not require that the same direction be used in all embodiments. For example, an upward/downward direction described with respect to the drawings may correspond to an upward/downward direction for a vertical portion of a production string and a left-to-right direction for a horizontal portion of a production string.

Overview

A disconnect tool can be part of a production string (also referred to as a completion string) in a wellbore. The disconnect tool can include a disconnect sub and a disconnect receptacle. The disconnect sub can be inserted into the disconnect receptacle such that the disconnect sub is concentric with the disconnect receptacle. The disconnect sub can be coupled to an upper portion of a production string and the disconnect receptacle can be coupled to a lower portion of the production string. Alternatively, the disconnect receptacle can be coupled to the upper portion of a production string and the disconnect sub can be coupled to the lower portion of the production string. Insertion of the disconnect sub into the disconnect receptacle can complete multiple hydraulic and multiple electrical connections between one or more control systems uphole of the disconnect tool and one or more devices downhole from the disconnect tool along the lower portion of the control string. The disconnect tool allows the upper portion of the production string to be removed leaving devices in the lower production string undisturbed. The upper portion of the production string can be replaced, with the disconnect sub being reinserted into the disconnect receptacle, thereby recompleting the hydraulic and electrical connections. Such removal and reinsertion can take place multiple times.

Some embodiments of the disconnect tool described herein provide advantages over conventional systems. Conventional systems typically only allow one electrical line to be bypassed. The embodiments provide the ability to use multiple electrical lines to connect a control system to downhole devices. For example, twisted pair conductors and tri-wire TEC (Tubing Encased Conductor) can be used in some embodiments.

Example Well System

FIG. 1 illustrates an example well system 100 that may employ one or more embodiments of the disconnect tool described herein. As illustrated, the well system 100 may include wellhead equipment 102 arranged at the Earth's surface 104 and a wellbore 106 extending therefrom and penetrating a subterranean formation 108. The wellhead equipment 102 may encompass a drilling rig, a wellhead installation, a Christmas tree, a work-over rig, a service rig, etc. It should be noted that, even though FIG. 1 depicts a land-based well system 100, it will be appreciated that the embodiments disclosed herein are equally well suited for use in any other type of rig including, but not limited to, floating or sea-based platforms and rigs, or rigs used in any other geographical location without departing from the scope of the disclosure.

In some embodiments, the wellhead equipment 102 may be an oil and gas rig. The wellhead equipment 102 and associated downhole tools may be used to stimulate and otherwise prepare the wellbore 106 and surrounding subterranean formation 108 for the production of hydrocarbons therefrom. In yet other embodiments, the wellhead equipment 102 may be a wellhead assembly configured for the production of hydrocarbons from the wellbore 106.

The wellhead equipment 102 may support or otherwise help manipulate the axial position of a wellbore tubular 114 as extended into the wellbore 106. In some embodiments, the wellbore tubular 114 may include, but not be limited to, one or more types of connected lengths of drill string, casing string, production tubing, landing string, liners, coiled tubing, combinations thereof, and the like. As illustrated in FIG. 1, the wellbore 106 may extend substantially vertically away from the surface 104 over a vertical wellbore portion. In other embodiments, the wellbore 106 may otherwise deviate at any angle from the surface 104 over a deviated or horizontal wellbore portion. In some embodiments, portions or substantially all of the wellbore 106 may be vertical, deviated, horizontal, and/or curved.

In an embodiment, the wellbore 106 may be at least partially cased with a casing string 116 or may otherwise remain at least partially or wholly uncased. The casing string 116 may be secured into position within the wellbore 106 using, for example, cement 118. In other embodiments, the casing string 116 may be only partially cemented within the wellbore 106 or, alternatively, may be entirely uncemented. A lower portion of wellbore tubular 114 may extend into a branch or lateral portion 120 of the wellbore 106. As illustrated, the lateral portion 120 may be an uncased or "open hole" section of the wellbore 106. In some embodiments, the entirety of the wellbore 106 is uncased.

The well system 100 may further include one or more downhole devices 126 (shown as 126*a*, 126*b*, and 126*c*) arranged in, coupled to, or otherwise forming an integral part of the wellbore tubular 114. In some embodiments, the downhole devices 126 may be coupled to the wellbore tubular 114 in the form of a sleeve surrounding the wellbore tubular 114. Examples of downhole devices include sensor devices (pressure, temperature, density, fluid flow etc.), pumps, packers, gauges, valves, chokes, and other devices used to monitor and control operations performed in the wellbore. Those of skill in the art will appreciate that a well system can have fewer or more than three downhole devices.

A control system 134 may control various aspects of the operations performed in the wellbore. The control system 134 can include processor and memory resources that can control various aspects of the operation of the well system 100. In some aspects, the control system may be coupled to downhole devices 126 via wires and/or hydraulic connections that can run in corridors within the wellbore tubular 114. Although shown as being at the surface, the control system 134 can be located anywhere either above or below the surface.

Well system 100 includes a disconnect tool 150. In some aspects, the disconnect tool 150 can be located between an upper portion 130 and a lower portion 132 of the wellbore tubular 114. During normal operations of the well system 100, the disconnect tool 150 operates like other sections of the wellbore tubular 114. That is, wellbore fluids can pass through an interior bore of the disconnect tool 150, and electrical connections and hydraulic connections can be maintained through the disconnect tool 150. It may become desirable to remove the upper portion 130 of the wellbore tubular, for example to perform maintenance work, to replace one or more downhole devices 126, etc. In such cases, the upper portion 130 of the wellbore tubular 114 can be removed while the lower portion 132 remains in place. The removal can be performed without damaging the upper portion 130 and lower portion 132. As will be further described in detail below, the disconnect tool 150 can provide the capability to reinsert an upper portion 130 of the wellbore tubular and to reestablish electrical and hydraulic connection between the upper portion 130 and lower portion 132 of the wellbore tubular 114. Although shown as being placed in a substantially vertical position along wellbore tubular 114, the embodiments are not limited to such a placement. In some embodiments, the disconnect tool 150 can be placed vertically, horizontally, or at an angle within the wellbore tubular.

Figure 2:
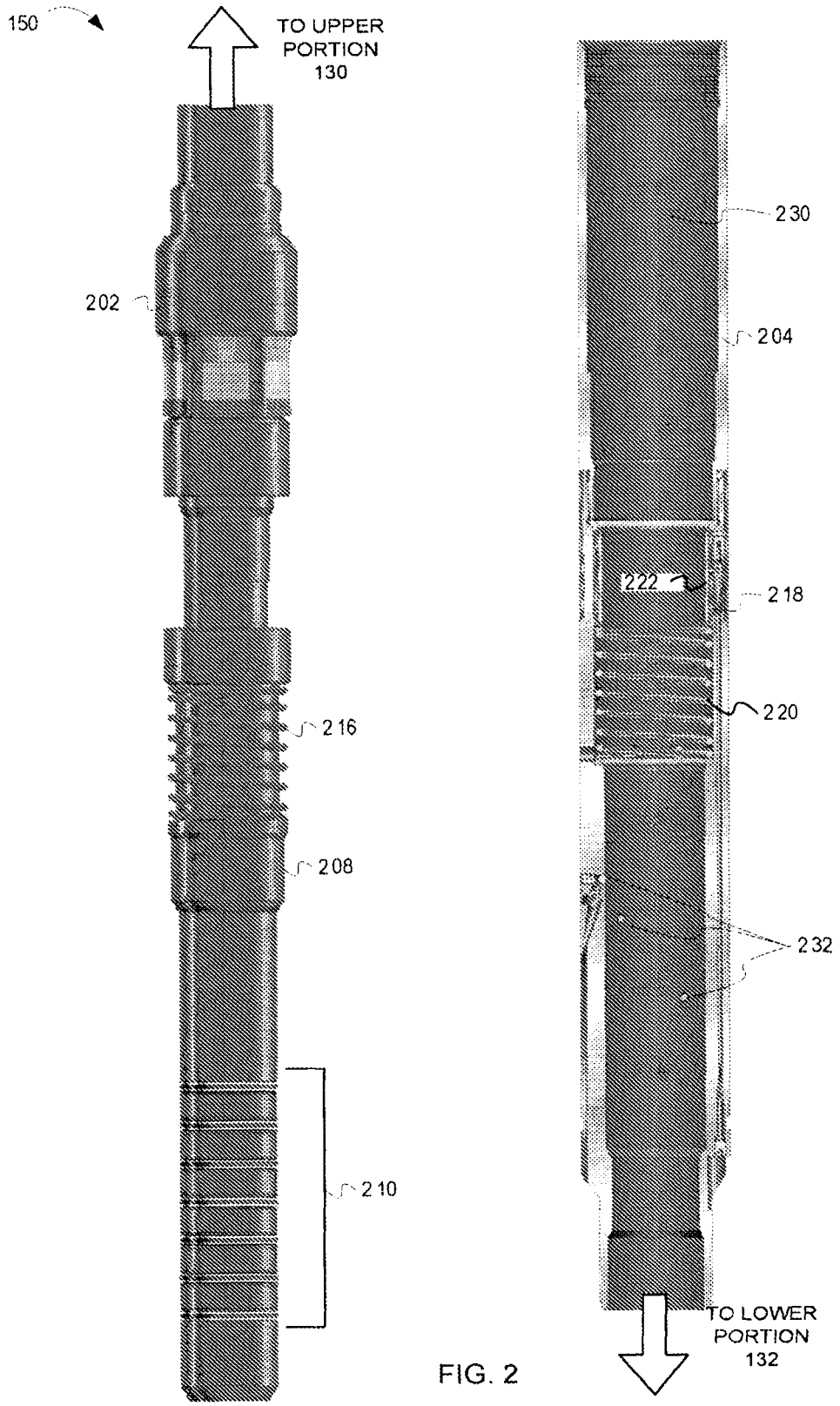
FIG. 2 illustrates further details of disconnect tool according to embodiments.
Figure 3:
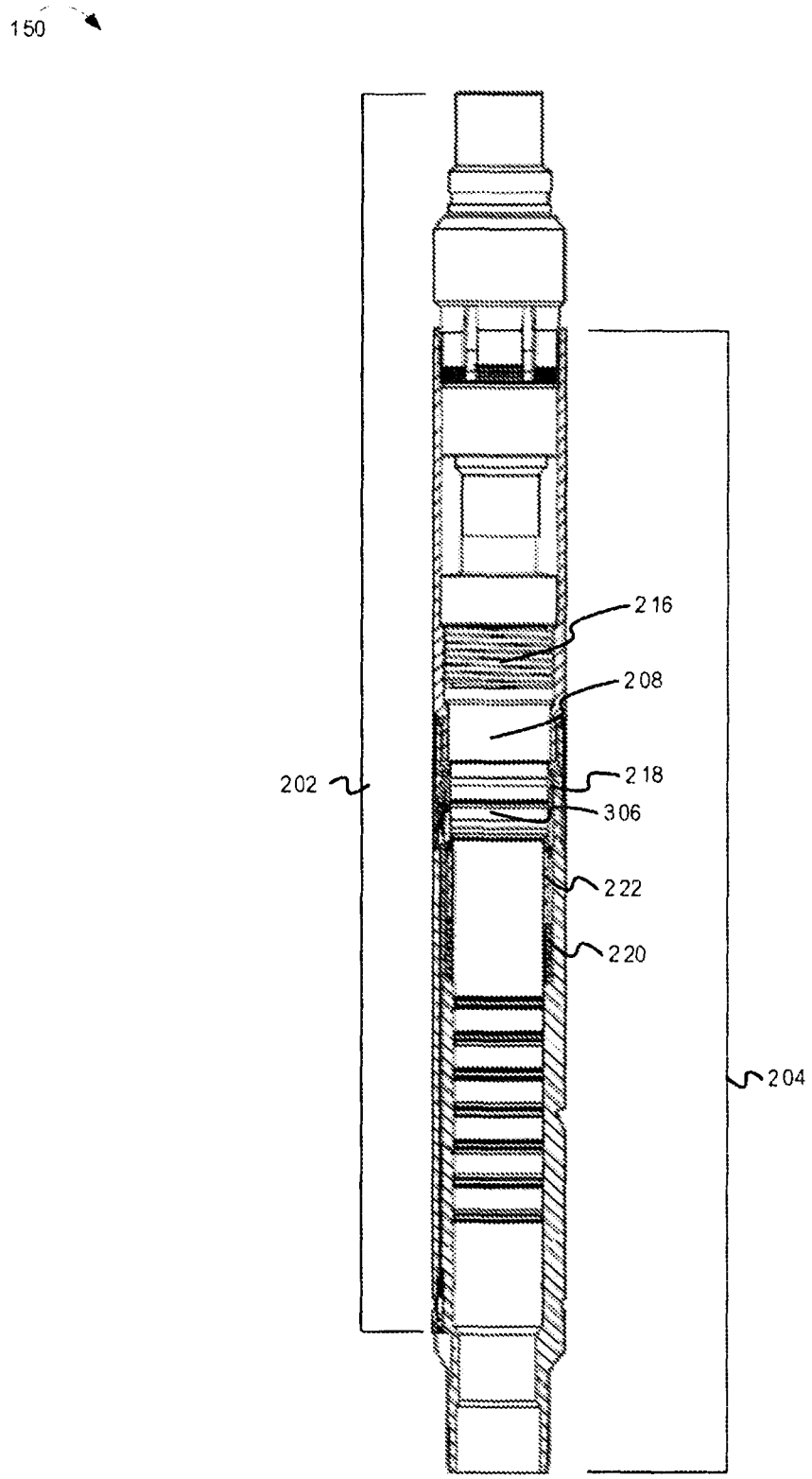
FIG. 3 illustrates further details of disconnect tool according to embodiments where the disconnect sub of the disconnect tool has been inserted into the disconnect receptacle of the disconnect tool.

FIG. 2 illustrates further details of disconnect tool 150 according to embodiments. The disconnect tool 150 includes a disconnect sub 202 and a disconnect receptacle 204. In some aspects, the disconnect sub 202 is a male portion and disconnect receptacle 204 is a female portion where the disconnect sub 202 can be removably inserted into a bore 230 of the disconnect receptacle 204. When inserted into the disconnect receptacle 204, the disconnect sub 202 is concentric with the disconnect receptacle 204. With reference to the well system 100 shown in FIG. 1, the disconnect sub 202 of the disconnect tool 150 can be coupled to the end of the upper portion 130 of the well bore tubular 114, and the disconnect receptacle 204 of the disconnect tool can be coupled to the lower portion 132 of the wellbore tubular 114. Disconnect sub 202 includes a male connector band 306 (FIG. 3). In some embodiments, a spring 216 exerts pressure on a sleeve 208 to cause the sleeve 208 to extend over and cover the male connector band 306 when the disconnect sub 202 is not fully inserted into the disconnect receptacle 204.

Disconnect receptacle 204 includes a female connector band 218. In some embodiments, a spring 220 exerts pressure on a sleeve 222 that covers the female connector band 218 when the disconnect sub 202 is not fully inserted into the disconnect receptacle 204.

Embodiments of disconnect sub 202 may include a series of seals, indicated by bracket 210, the form individual hydraulic passages between the respective seals when disconnect sub 202 is inserted into disconnect receptacle 204. Disconnect receptacle 204 may include ports 232 that are positioned along disconnect receptacle 204 to that one or more of the ports 232 is positioned adjacent to a respective one of the hydraulic passages located between the seals of the disconnect sub 202 when the disconnect sub 202 is fully inserted into the disconnect receptacle 204. The hydraulic passages and ports 232 may be configured to form one or more hydraulic connections between the disconnect sub 202 and the disconnect receptacle 204 when the disconnect sub 202 is fully inserted into the disconnect receptacle 204.

FIG. 3 illustrates further details of disconnect tool 150 according to embodiments where the disconnect sub 202 of the disconnect tool 150 has been inserted into the disconnect receptacle 204 of the disconnect tool 150. Disconnect receptacle 204 is illustrated in FIG. 3 as a cross-section. The disconnect sub 202 can be set down on top of the disconnect receptacle 204 and inserted into the disconnect receptacle 204. When the disconnect sub 202 is inserted into the disconnect receptacle 204, a latching mechanism can be used to secure the disconnect sub 202 to the disconnect receptacle 204. In some embodiments, a snap latch can be used. In alternative embodiments, an anchor latch can be used. In further alternative embodiments, a shear ring or a hydraulic release can be used. Upon insertion, sleeve 208 of the disconnect sub 202 retracts exposing male connector band 306. Similarly, sleeve 222 of the disconnect receptacle retracts exposing female connector band 218. After the respective sleeves 208 and 222 have retracted, electrically conductive sections of the outside portion of the male connector band 306 can make contact with electrically conductive sections of the inside portion of the female connector band 218 as further described below.

Removal of the disconnect sub 202 from the disconnect receptacle 204 can depend on the latching mechanism used. For example, in embodiments where a snap latch is used, overpull can be applied to the disconnect sub 202 to cause the disconnect sub 202 to disengage from the disconnect receptacle 204. In embodiments where an anchor latch is used, the disconnect sub 202 can be rotated and pulled to cause the disconnect sub 202 to disengage from the disconnect receptacle 204. In embodiments where a shear ring is used, overpull above the shear rating can be applied to the disconnect sub 202 to cause the disconnect sub 202 to disengage from the disconnect receptacle 204. In embodiments where a hydraulic release is used, hydraulic pressure can be applied to a piston to cause the piston to move and thereby unlatch the disconnect sub 202 from the disconnect receptacle 204. As the disconnect sub 202 is removed from the disconnect receptacle 204, sleeves 208 and 222 can cover the male connector band 306 and female connector band 218 respectively.

Figure 4:
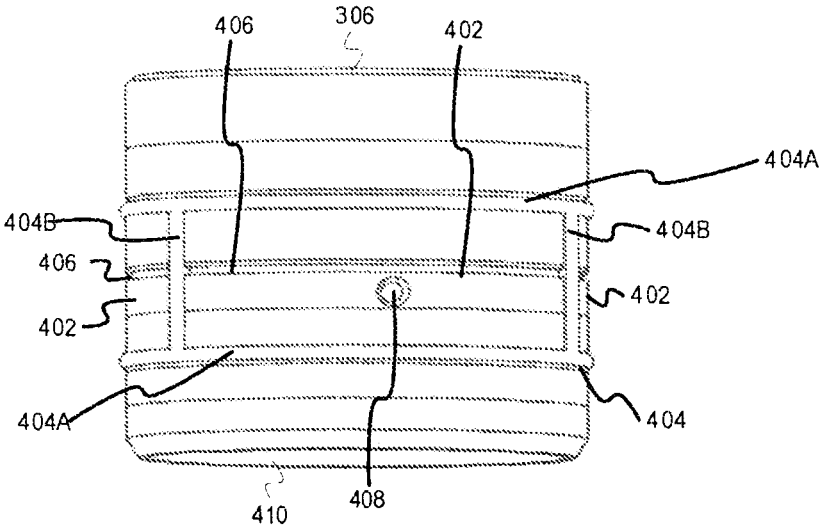
FIG. 4 illustrates further details of a male connector band of a disconnect tool according to embodiments.

FIG. 4 illustrates further details of a male connector band 306 of a disconnect tool 150 according to embodiments. The male connector band 306 is divided circumferentially into multiple electrically conductive sections 402. In some embodiments, the male connector band 306 includes three electrically conductive sections 402. Each electrically conductive section 402 can be electrically insulated from one another and from the wellbore using a seal 404. In some embodiments, the seal 404 can be made of an elastomeric material or polytetrafluoroethylene (PTFE). Seal 404 includes two circumferential portions 404A and longitudinal portions 404B. In the example embodiments illustrated in FIG. 4, two longitudinal portions 404B divide the male connector band into three electrically conductive sections 402. Those of skill in the art having the benefit of the disclosure will appreciate that there can be more or fewer than three electrically conductive sections. The circumferential portions 404A of seal 404 can prevent wellbore fluids from entering the region between the seals when the disconnect sub 202 of the disconnect tool 150 is engaged within the disconnect receptacle 204, and therefore acts as an electrical insulator between the two fluids. The longitudinal portions 404B of the seal can insulate the individual electrically conductive sections 402 from one another. In some aspects, the seal 404 fits into grooves formed in the male connector band. As shown in the example embodiments illustrated in FIG. 4, seal 404 is a one piece seal. In alternative embodiments, the annular portions 404A and longitudinal portions 404B can be separate pieces that together form seal 404. An electrically conductive section 402 of male connector band 306 can include a groove 406. An electrically conductive material can be placed in the groove 406. In some embodiments, an electrically conductive spring (not shown) can be welded or otherwise fastened into a groove 406 to provide contact between the electrically conductive section 402 of the male connector band 306 and a corresponding electrically conductive section of the female connector band 218.

An electrically conductive section 402 can include a connector opening 408. In some embodiments, connector opening 408 is threaded. An electrically conductive screw (not shown) can be threaded into connector opening 408 to make contact with an electrical wire running in conduit within the disconnect sub 202 of disconnect tool 150. In some embodiments, the electrical wire can be a conductor in a twisted pair, a conductor of a tri-wire TEC, or other multi-conductor wire system.

In some embodiments, the male connector band 306 is concentric with the disconnect sub 202 and positioned around the outside diameter of the disconnect sub 202. An insulating layer can be positioned between the inside diameter of the male connector band 306 and the outside diameter of the disconnect sub 202. In some aspects, an insulating layer 410 can be part of the male connector band 306. The insulating layer 410 can be composed of polyetheretherketone (PEEK).

Figure 5:
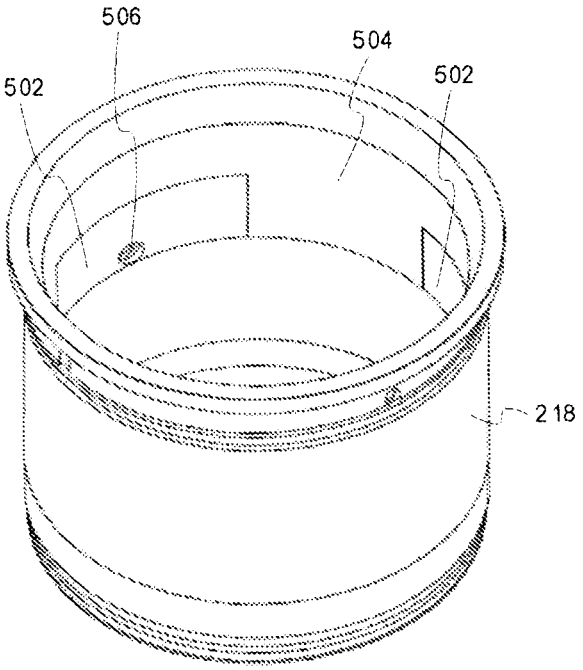
FIG. 5 illustrates further details of the female connector band of a disconnect tool according to embodiments.

FIG. 5 illustrates further details of the female connector band 218 of a disconnect tool according to embodiments. In some embodiments, the female connector band 218 includes multiple electrically conductive sections 502 separated by an insulator section 504. The number of electrically conductive sections 502 in the female connector band 218 can match the number of electrically conductive sections 502 of the male connector band 306. For example, in some embodiments, there can be three electrically conductive sections 502 in the male connector band 306 and three electrically conductive sections 502 in the female connector band 218. Those of skill in the art having the benefit of the disclosure will appreciate that there can be more or fewer than three electrically conductive sections in the female connector band 218 and the male connector band 306.

The insulator section 504 can be composed of a thermoplastic material that is resistant to degradation in the presence of hydrocarbons at the temperatures and pressures that may exist in the wellbore. As an example, in some embodiments, the insulator section 504 can be composed of PEEK.

In some aspects, the female connector band 218 can be positioned in the inside diameter of the disconnect receptacle 204. An electrical insulator layer can be between the outside diameter of the female connector band 218 and the inside diameter of the disconnect receptacle 204. In some aspects, the electrical insulator layer can be part of the female connector band 218.

An electrically conductive section 502 can include a connector opening 506. In some embodiments, connector opening 506 can be threaded. An electrically conductive screw (not shown) can be threaded into connector opening 506 to make contact with an electrical wire running in conduit within the disconnect receptacle 204 of disconnect tool 150. The electrical wire can connect to a conductor from a TEC going downhole to downhole devices 126 and other tools.

In some embodiments, the female connector band 218 is positioned around the inside diameter of a disconnect receptacle 204 of the disconnect tool 150 and concentric with the disconnect receptacle 204 of the disconnect tool 150.

Figure 6:
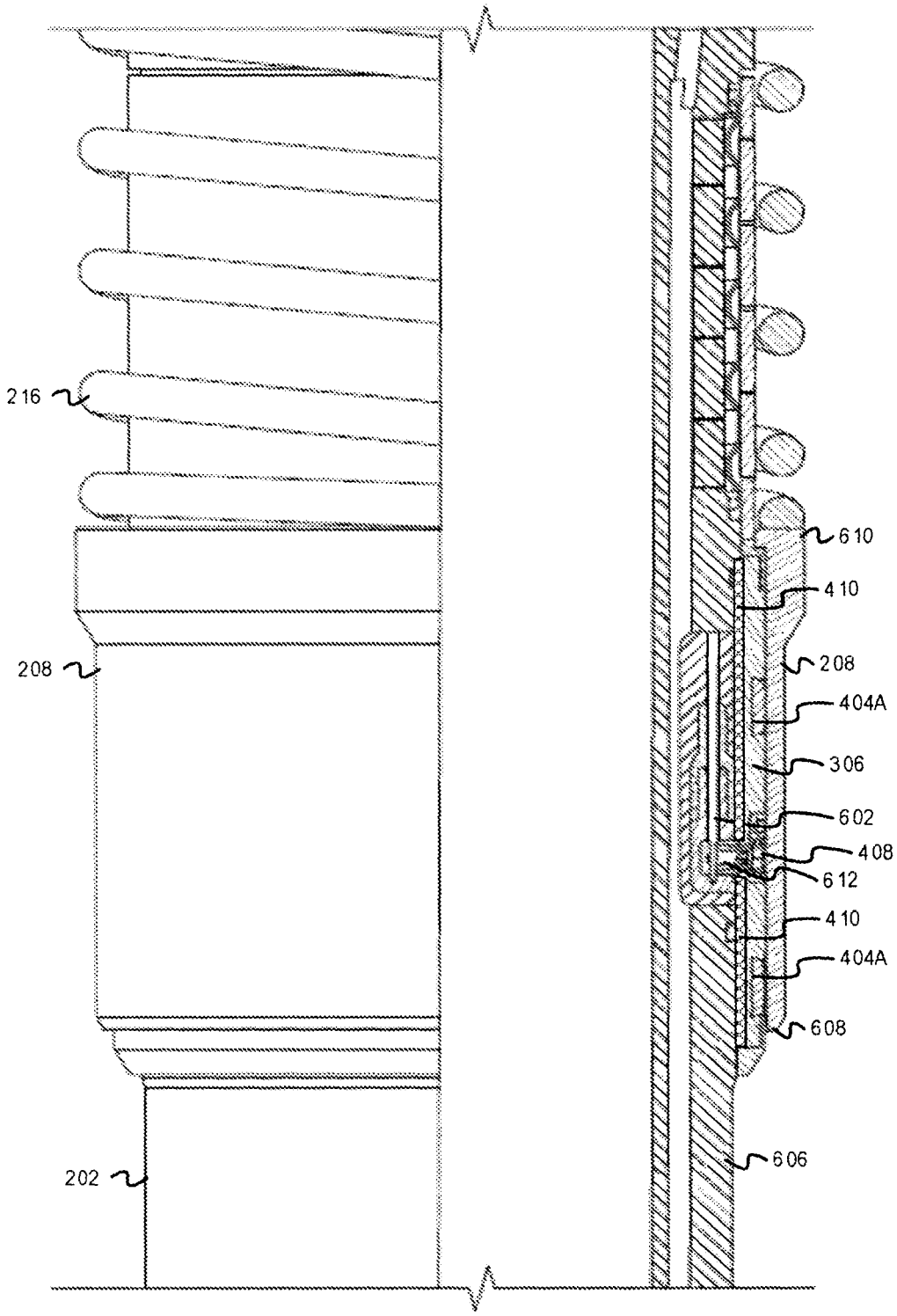
FIG. 6 is a diagram illustrating a cross section of the disconnect sub with the male connector band positioned around the outside diameter of the disconnect sub.

FIG. 6 is a diagram illustrating a cross section of the disconnect sub 202 with the male connector band 306 positioned around the outside diameter of the disconnect sub 202. Spring 216 exerts pressure on an upper edge 610 of the sleeve 208. In the case where the disconnect sub 202 is not inserted into a disconnect receptacle 204 (as in the example illustrated in FIG. 6), sleeve 208 covers the male connector band 306 and the seal 404 of the male connector band 306. Upon insertion into a disconnect receptacle 204, the lower edge 608 of the sleeve 208 makes contact with an annular edge on the inside diameter of the disconnect receptacle causing the sleeve 208 to be pushed upward, thereby uncovering the male connector band 306.

An electrically conductive fastener 612 can be inserted into connector opening 408. The fastener can electrically couple an electrically conductive section 402 of male connector band 306 with an exposed end of a wire 602. The fastener can be an electrically conductive screw, or a fastener that is held in place using friction, compression or a latching mechanism. The wire 602 can run through a conduit or channel in a wall 606 of disconnect sub 202. In some aspects, the wire 602 can run through the conduit of the disconnect sub 202 and terminate to a TEC connected to the disconnect sub 202, and can be coupled either directly or indirectly to a control system 134 (FIG. 1). As discussed above, a male connector band 306 can have multiple electrically conductive sections 402. Wires can be coupled to these electrically conductive sections in the same manner as discussed above and can run through other conduit or channels of disconnect sub 202.

Figure 7:
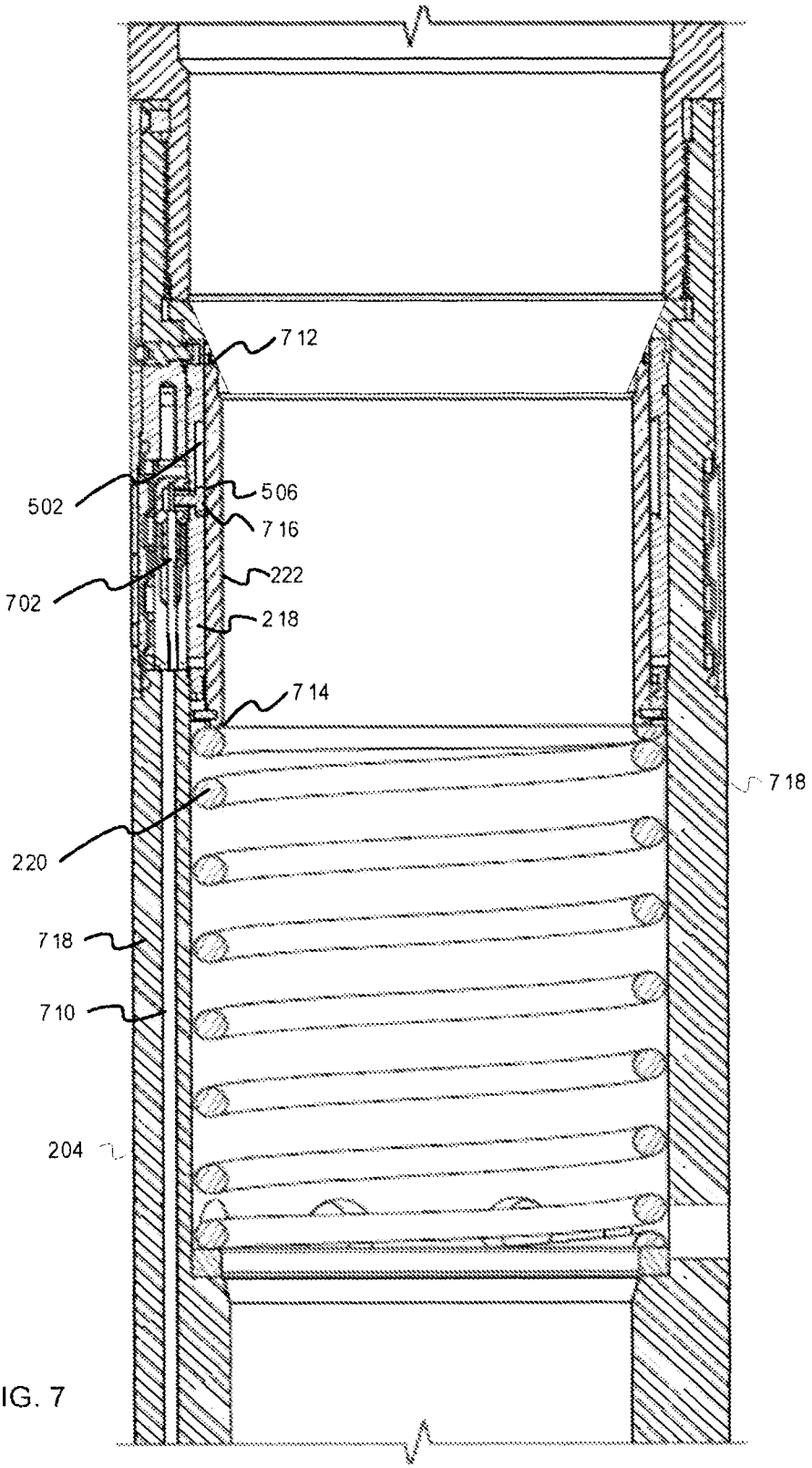
FIG. 7 is a diagram illustrating a cross section of the disconnect receptacle with the female connector band positioned around the inside diameter of the disconnect receptacle.

FIG. 7 is a diagram illustrating a cross section of the disconnect receptacle 204 with the female connector band 218 positioned around the inside diameter of the disconnect receptacle 204. Spring 220 exerts pressure on a lower edge 714 of the sleeve 222. Thus, when a disconnect sub 202 is not inserted in the disconnect receptacle 204 (as in the example illustrated in FIG. 7), sleeve 222 covers the female connector band 218. When a disconnect sub 202 is inserted into the disconnect receptacle 204, the upper edge 712 of the sleeve 222 makes contact with the disconnect sub 202 causing the sleeve 222 to be pushed downward, thereby uncovering the female connector band 218.

An electrically conductive fastener 716 can be inserted into connector opening 506. The fastener 716 can electrically couple an electrically conductive section 502 of female connector band 218 with an exposed end of a wire 702. The fastener can be an electrically conductive screw, or a fastener that is held in place using friction, compression or a latching mechanism. The wire 702 can run through a conduit 710 or channel in a wall 718 of disconnect receptacle 204. In some aspects, the wire 702 can run through the conduit 710 of the disconnect receptacle 204 and connect to a TEC conductor that runs downhole or other conduits in a production string, and can be coupled either directly or indirectly to downhole devices 126 (FIG. 1). As discussed above, a female connector band 218 can have multiple electrically conductive sections 502. Wires can be coupled to these electrically conductive sections in the same manner as discussed above and can run through other conduit or channels of disconnect receptacle 204.

Figure 8:
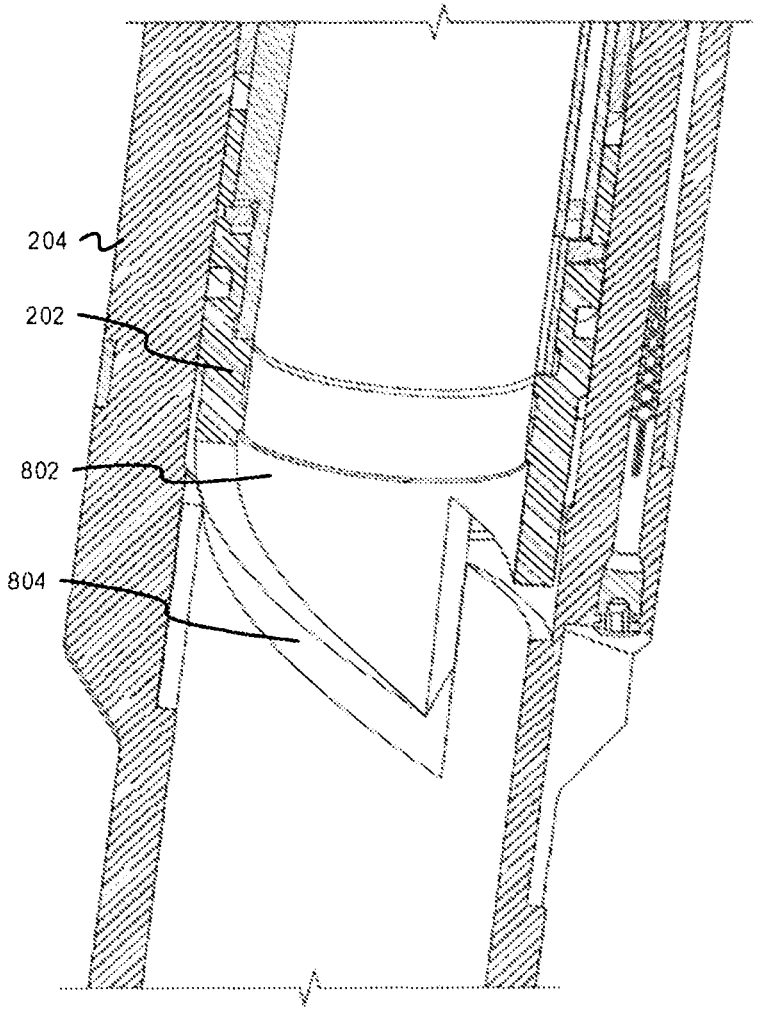
FIG. 8 is a diagram illustrating a cross section of a guide ring of a disconnect sub and guide receptacle for the disconnect receptacle according to embodiments.

FIG. 8 is a diagram illustrating a cross section of a guide ring 802 of a disconnect sub 202 and a corresponding guide receptacle 804 of the disconnect receptacle 204 according to embodiments. It can be desirable to ensure that male connector band 306 and female connector band 218 are sufficiently aligned so that electrically conductive section 402 of the male connector band 306 contacts only one electrically conductive section 502 of the female connector band 218. Further, it can be desirable to ensure that the axial portions of the seal 404 lie on the insulator section 504 between the electrically conductive sections 502 to electrically isolate them. In some embodiments, a guide ring 802 is placed on the end of disconnect sub 202 where the guide ring 802 is matched to a guide receptacle 804 of the disconnect receptacle 204. In some embodiments, the guide ring 802 and guide receptacle 804 are helical guides. In addition to the alignment described above, the guide ring 802 and guide receptacle 804 can serve to limit rotation between the disconnect sub 202 and disconnect receptacle 204.

In some embodiments, the guide ring 802 and guide receptacle 804 are configured such that when a disconnect sub 202 is inserted into a disconnect receptacle 204, a particular electrically conductive section 402 of the male connector band 306 makes contact with a particular electrically conductive section 502 of the female connector band 218. For example, the guide ring 802 and guide receptacle 804 may be configured such that electrically conductive section 402A only comes into contact with electrically conductive section 502A, electrically conductive section 402B only comes into contact with electrically conductive section 502B and so on.

In alternative embodiments, the guide ring 802 and guide receptacle are configured such that when a disconnect sub 202 is inserted into a disconnect receptacle 204, an electrically conductive section 402 of the male connector band 306 may make contact with any one of the electrically conductive sections 502 of the female connector band 218. For example, assume that the male connector band 306 has three electrically conductive sections 402A, 402B and 402C in clockwise order. Further assume that female connector band 218 has three electrically conductive sections 502A, 502B and 502C in clockwise order. In a first insertion of the disconnect sub 202 into disconnect receptacle 204, section 402A may make contact with 502B, 402B with 502C and 402C with 502A. An upper production string that includes the disconnect sub 202 may be removed from the wellbore, leaving a lower production string with disconnect receptacle 204 and downhole devices 126 in the wellbore. Upon reinsertion of the disconnect sub 202 into disconnect receptacle 204, section 402A may make contact with 502C, 402B with 502A and 402C with 502B. Thus, wires leading to a control system from the disconnect tool 150 may be connected differently in subsequent reinsertions of a disconnect sub 202 into a disconnect receptacle 204. In such embodiments, the control system 134 or other electronic system may determine which downhole devices 126 are coupled to wires connected to the disconnect sub 202 and disconnect receptacle 204. For example, the control system 134 may analyze signals received over the wire to determine what downhole device 126 is connected to the wire. Alternatively, the control system may send probe or request signals and analyze a response from the device to determine what type of downhole device is connected to the wire.

Variations

In the discussion above, the disconnect sub 202 is described as being connected to an upper portion 130 of a wellbore tubular 114, while the disconnect receptacle 204 has been described as being connected to a lower portion 132 of the wellbore tubular. In alternative embodiments, the connections can be reversed. That is, the disconnect receptacle 204 can be connected to the upper portion 130 of the wellbore tubular 114 and the disconnect sub 202 can be connected to the lower portion of the wellbore tubular 114. In such embodiments, the seal 404 can be in the receptacle and separate the electrically conductive sections of the female connector band 218. Thus, the seal 404 can be replaced if needed when the upper portion 130 of wellbore tubular is removed from the wellbore.

While the aspects of the disclosure are described with reference to various implementations and exploitations, it will be understood that these aspects are illustrative and that the scope of the claims is not limited to them. Many variations, modifications, additions, and improvements are possible.

Plural instances may be provided for components, operations or structures described herein as a single instance. Finally, boundaries between various components are somewhat arbitrary, and particular components are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Terminology

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

EXAMPLE EMBODIMENTS

Example embodiments include the following:

Embodiment 1

A disconnect tool comprising: a disconnect sub having a male connector band disposed on an outside diameter of the disconnect sub, the male connector band having a first plurality of electrically conductive sections separated by a first insulating material; and a disconnect receptacle having a female connector band disposed on an inside diameter of the disconnect receptacle, the disconnect receptacle having a second plurality of electrically conductive sections separated by a second insulating material; wherein upon insertion of the disconnect sub into the disconnect receptacle, the first plurality of electrically conductive sections are electrically coupled to the second plurality of electrically conductive sections.

Embodiment 2

The disconnect tool of embodiment 1, further comprising: a first retractable sleeve disposed on the disconnect sub and having a first position covering the male connector band and a second position uncovering the male connector band; and a second retractable sleeve disposed on the disconnect receptacle and having a first position covering the female connector band and a second position uncovering the female connector band; wherein upon insertion of the disconnect sub into the disconnect receptacle, the first retractable sleeve retracts to the second position uncovering the male connector band and the second retractable sleeve retracts to the second position uncovering the female connector band.

Embodiment 3

The disconnect tool of any of embodiments 1-2, wherein an electrically conductive section of the first plurality of electrically conductive sections includes a connector opening, the connector opening configured to receive a fastener to electrically couple the electrically conductive section to a wire disposed in a conduit of the disconnect sub.

Embodiment 4

The disconnect tool of any of embodiments 1-2, wherein an electrically conductive section of the first plurality of electrically conductive sections includes a groove to receive an electrically conductive spring, wherein the electrically conductive spring contacts a corresponding electrically conductive section of the female connector band upon insertion of the disconnect sub into the disconnect receptacle.

Embodiment 5

The disconnect tool of any of embodiments 1-4, wherein the insulating material comprises polyetheretherketone (PEEK).

Embodiment 6

The disconnect tool of any of embodiments 1-5, wherein the disconnect sub includes a guide ring and the disconnect receptacle includes a guide receptacle, wherein upon insertion of the disconnect sub into the disconnect receptacle, the guide ring aligns with the guide receptacle, wherein alignment of the guide ring with the guide receptacle aligns the first plurality of electrically conductive sections of the male connector band with the second plurality of electrically conductive sections of the female connector band.

Embodiment 7

The disconnect tool of embodiment 6, wherein particular ones of the first plurality of electrically conductive sections of the male connector band are aligned with particular ones of the second plurality of electrically conductive sections of the female connector band.

Embodiment 8

The disconnect tool of embodiment 6, wherein the guide ring comprises a helical guide ring and wherein the guide receptacle comprises a helical guide receptacle.

Embodiment 9

The disconnect tool of any of embodiments 1-8, wherein the first insulating material comprises a seal disposed on the male connector band, the seal separating the electrically conductive sections from one another.

Embodiment 10

The disconnect tool of embodiment 9, wherein the seal comprises two annular rings configured to prevent wellbore fluids from entering an area between the male connector band and the female connector band, the two annular rings electrically insulating the first plurality of electrically conductive sections on the male connector band and the second plurality of electrically conductive sections on the female connector band from well bore fluids.

Embodiment 11

The disconnect tool of embodiment 10, wherein seal comprises a plurality of longitudinal portions, the longitudinal portions separating the electrically conductive sections from one another.

Embodiment 12

The disconnect tool of any of embodiments 1-11, wherein the disconnect receptacle is coupled to an upper production string and the disconnect sub is coupled to a lower production string.

Embodiment 13

A wellbore system comprising: an upper production string; a disconnect tool having a disconnect sub coupled to the upper production string and a disconnect receptacle; a lower production string coupled to the disconnect receptacle; a plurality of downhole devices disposed on or within the lower production string; a male connector band disposed on an outside diameter of the disconnect sub, the male connector band having a first plurality of electrically conductive sections; and a female connector band disposed on an inside diameter of the disconnect receptacle, the disconnect receptacle having a second plurality of electrically conductive sections separated by an insulating material; wherein upon insertion of the disconnect sub into the disconnect receptacle, the first plurality of electrically conductive sections are electrically coupled to the second plurality of electrically conductive sections.

Embodiment 14

The wellbore system of embodiment 13, wherein the second plurality of electrically conductive sections are electrically coupled to the plurality of downhole devices.

Embodiment 15

The wellbore system of any of embodiments 13-14, wherein the first plurality of electrically conductive sections are electrically coupled to a control system.

Embodiment 16

The wellbore system of any of embodiments 13-15, further comprising: a first retractable sleeve disposed on the disconnect sub and having a first position covering the male connector band and a second position uncovering the male connector band; and a second retractable sleeve disposed on the disconnect receptacle and having a first position covering the female connector band and a second position uncovering the female connector band; wherein upon insertion of the disconnect sub into the disconnect receptacle, the first retractable sleeve retracts to the second position uncovering the male connector band and the second retractable sleeve retracts to the second position uncovering the female connector band.

Embodiment 17

The wellbore system of any of embodiments 13-16, wherein the disconnect sub includes a guide ring and the disconnect receptacle includes a guide receptacle, wherein upon insertion of the disconnect sub into the disconnect receptacle, the guide ring aligns with the guide receptacle, wherein alignment of the guide ring with the guide receptacle aligns the first plurality of electrically conductive sections of the male connector band with the second plurality of electrically conductive sections of the female connector band.

Embodiment 18

The wellbore system of embodiment 17, wherein particular ones of the first plurality of electrically conductive sections of the male connector band are aligned with particular ones of the second plurality of electrically conductive sections of the female connector band.

Embodiment 19

The wellbore system of any of embodiments 13-18, further comprising a seal disposed on the male connector band, the seal separating the electrically conductive sections from one another.

Embodiment 20

The wellbore system of embodiment 19, wherein the seal comprises: two annular rings configured to prevent wellbore fluids from entering an area between the male connector band and the female connector band; and a plurality of longitudinal portions, the longitudinal portions separating the electrically conductive sections from one another.

What is claimed is:

1. A disconnect tool comprising:

a disconnect sub and a disconnect receptacle, the disconnect tool configured to be coupled to an upper production string within a wellbore and to a lower production string within the wellbore, and to provide one or more electrical connections through the disconnect tool;

the disconnect sub having a male connector band disposed on an outside diameter of the disconnect sub, the male connector band divided circumferentially into a first plurality of electrically conductive sections separated by a first insulating material that electrically insulates each of the first plurality of electrically conductive sections for one another; and the disconnect receptacle having a female connector band disposed on an inside diameter of the disconnect receptacle, the female connector band divided circumferentially into a second plurality of electrically conductive sections separated by a second insulating material that electrically insulates each of the second plurality of electrically conductive sections for one another;

wherein upon insertion of the disconnect sub into the disconnect receptacle, the first plurality of electrically conductive sections are electrically coupled to the second plurality of electrically conductive sections.

2. The disconnect tool of claim 1, further comprising:

a first retractable sleeve disposed on the disconnect sub and having a first position covering the male connector band and a second position uncovering the male connector band; and a second retractable sleeve disposed on the disconnect receptacle and having a first position covering the female connector band and a second position uncovering the female connector band;

wherein upon insertion of the disconnect sub into the disconnect receptacle, the first retractable sleeve retracts to the second position uncovering the male connector band and the second retractable sleeve retracts to the second position uncovering the female connector band.

3. The disconnect tool of claim 1, wherein an electrically conductive section of the first plurality of electrically conductive sections includes a connector opening, the connector opening configured to receive a fastener to electrically couple the electrically conductive section to a wire disposed in a conduit of the disconnect sub.

4. The disconnect tool of claim 1, wherein an electrically conductive section of the first plurality of electrically conductive sections includes a groove to receive an electrically conductive spring, wherein the electrically conductive spring contacts a corresponding electrically conductive section of the female connector band upon insertion of the disconnect sub into the disconnect receptacle.

5. The disconnect tool of claim 1, wherein the first insulating material comprises polyetheretherketone (PEEK).

6. The disconnect tool of claim 1, wherein the disconnect sub includes a guide ring and the disconnect receptacle includes a guide receptacle, wherein upon insertion of the disconnect sub into the disconnect receptacle, the guide ring aligns with the guide receptacle, wherein alignment of the guide ring with the guide receptacle aligns the first plurality of electrically conductive sections of the male connector band with the second plurality of electrically conductive sections of the female connector band.

7. The disconnect tool of claim 6, wherein particular ones of the first plurality of electrically conductive sections of the male connector band are aligned with particular ones of the second plurality of electrically conductive sections of the female connector band.

8. The disconnect tool of claim 6, wherein the guide ring comprises a helical guide ring and wherein the guide receptacle comprises a helical guide receptacle.

9. The disconnect tool of claim 1, wherein the first insulating material comprises a seal disposed on the male connector band, the seal separating the first plurality of electrically conductive sections from one another.

10. The disconnect tool of claim 9, wherein the seal comprises two annular rings configured to prevent wellbore fluids from entering an area between the male connector band and the female connector band, the two annular rings electrically insulating the first plurality of electrically conductive sections on the male connector band and the second plurality of electrically conductive sections on the female connector band from well bore fluids.

11. The disconnect tool of claim 9, wherein the seal comprises a plurality of longitudinal portions, the longitudinal portions separating the first plurality of electrically conductive sections from one another.

12. The disconnect tool of claim 1, wherein the disconnect receptacle is configured to be coupled to the lower production string and the disconnect sub is configured to be coupled to the upper production string.

13. A wellbore system comprising:

an upper production string;

a disconnect tool having a disconnect sub coupled to the upper production string and a disconnect receptacle;

a lower production string coupled to the disconnect receptacle;

a plurality of downhole devices disposed on or within the lower production string;

a male connector band disposed on an outside diameter of the disconnect sub, the male connector band divided circumferentially into a first plurality of electrically conductive sections separated by a first insulating material that electrically insulates each of the first plurality of electrically conductive sections for one another; and a female connector band disposed on an inside diameter of the disconnect receptacle, the female connector band divided circumferentially into a second plurality of electrically conductive sections separated by a second insulating material that electrically insulates each of the second plurality of electrically conductive sections for one another;

wherein upon insertion of the disconnect sub into the disconnect receptacle, the first plurality of electrically conductive sections are electrically coupled to the second plurality of electrically conductive sections.

14. The wellbore system of claim 13, wherein the second plurality of electrically conductive sections are electrically coupled to the plurality of downhole devices.

15. The wellbore system of claim 13, wherein the first plurality of electrically conductive sections are electrically coupled to a control system.

16. The wellbore system of claim 13, further comprising:

a first retractable sleeve disposed on the disconnect sub and having a first position covering the male connector band and a second position uncovering the male connector band; and a second retractable sleeve disposed on the disconnect receptacle and having a first position covering the female connector band and a second position uncovering the female connector band;

wherein upon insertion of the disconnect sub into the disconnect receptacle, the first retractable sleeve retracts to the second position uncovering the male connector band and the second retractable sleeve retracts to the second position uncovering the female connector band.

17. The wellbore system of claim 13, wherein the disconnect sub includes a guide ring and the disconnect receptacle includes a guide receptacle, wherein upon insertion of the disconnect sub into the disconnect receptacle, the guide ring aligns with the guide receptacle, wherein alignment of the guide ring with the guide receptacle aligns the first plurality of electrically conductive sections of the male connector band with the second plurality of electrically conductive sections of the female connector band.

18. The wellbore system of claim 17, wherein particular ones of the first plurality of electrically conductive sections of the male connector band are aligned with particular ones of the second plurality of electrically conductive sections of the female connector band.

19. The wellbore system of claim 13, further comprising a seal disposed on the male connector band, the seal separating the first plurality of electrically conductive sections from one another.

20. The wellbore system of claim 19, wherein the seal comprises:

two annular rings configured to prevent wellbore fluids from entering an area between the male connector band and the female connector band; and a plurality of longitudinal portions, the longitudinal portions separating the first plurality of electrically conductive sections from one another.

* * * * *